US008069985B2

(12) United States Patent
Burattini

(10) Patent No.: US 8,069,985 B2
(45) Date of Patent: Dec. 6, 2011

(54) SEALED SINGLE-DOSE BREAK-OPEN PACKAGE

(75) Inventor: Christian Burattini, Persiceto (IT)

(73) Assignee: Diapack Ltd, London (GB)

( * ) Notice: Subject to any disclaimer, the term of this patent is extended or adjusted under 35 U.S.C. 154(b) by 0 days.

(21) Appl. No.: 11/913,737

(22) PCT Filed: May 18, 2007

(86) PCT No.: PCT/IB2007/001285

§ 371 (c)(1),
(2), (4) Date: Oct. 19, 2009

(87) PCT Pub. No.: WO2008/038074

PCT Pub. Date: Apr. 3, 2008

(65) Prior Publication Data

US 2010/0059402 A1 Mar. 11, 2010

(30) Foreign Application Priority Data

Sep. 28, 2006 (IT) ..... B02006A0665
Sep. 28, 2006 (IT) ..... B02006A0666
Feb. 14, 2007 (IT) ..... B02007A0083

(51) Int. Cl.
*B65D 73/00* (2006.01)
*B65D 47/10* (2006.01)
*B65D 17/00* (2006.01)

(52) U.S. Cl. ..... 206/469; 222/541.6; 229/237; 383/202

(58) Field of Classification Search ..... 206/469, 206/484–484.2; 222/92, 107, 541.6; 229/4.5, 229/200, 237; 383/202
See application file for complete search history.

(56) References Cited

U.S. PATENT DOCUMENTS

| | | | | | |
|---|---|---|---|---|---|
| 2,215,705 | A | * | 9/1940 | Lenz | 229/237 |
| 3,075,684 | A | * | 1/1963 | Rothmann | 229/237 |
| 3,472,368 | A | * | 10/1969 | Hellstrom | 206/469 |
| 4,236,652 | A | * | 12/1980 | Beguhn | 222/92 |
| 4,762,230 | A | | 8/1988 | Croce | |
| 5,395,298 | A | * | 3/1995 | Moesmann | 383/202 |
| 6,041,930 | A | | 3/2000 | Cockburn | |
| 6,945,391 | B2 | | 9/2005 | Moodie | |
| 7,506,762 | B2 | * | 3/2009 | Nelson et al. | 206/484.1 |

FOREIGN PATENT DOCUMENTS

| | | |
|---|---|---|
| FR | 73761 | 9/1960 |
| FR | 1476746 | 4/1967 |
| WO | WO 9220595 | 11/1992 |
| WO | WO 9706073 | 2/1997 |
| WO | WO 03000162 | 1/2003 |

OTHER PUBLICATIONS

Internation Search Report date of mailing May 2, 2008; Application No. WO 2008/038074 publication dated Apr. 3, 2008; 9 pages.

* cited by examiner

*Primary Examiner* — Bryon P Gehman
(74) *Attorney, Agent, or Firm* — Thomas & Karceski, PC

(57) ABSTRACT

A sealed single-dose break-open package (1) having: a first sheet (2) of semirigid plastic material; a second sheet (3) of flexible plastic material superimposed on and sealed to the first sheet (2) of semirigid plastic material to define a sealed pocket (4) containing a dose of a product (5); and an incision (6) formed in the first sheet (2) of semirigid plastic material to guide controlled breakage of the first sheet (2) along the incision (6) and form an outlet opening for the product (5) through the first sheet (2); the incision (6) varies in depth lengthwise to break the first sheet (2) gradually along the incision (6).

17 Claims, 8 Drawing Sheets

SEALED SINGLE-DOSE BREAK-OPEN PACKAGE

CROSS-REFERENCE TO RELATED APPLICATIONS

This application claims priority to International Application No. PCT/IB2007/001285, filed May 18, 2007, which in turn claims priority to Italian Patent Application Nos. BO2006A000665, filed Sep. 28, 2006, BO2006A000666 filed Sep. 28, 2006, and BO2007A000083, filed Feb. 14, 2007.

FIELD OF THE INVENTION

The present invention relates to a sealed single-dose break-open package. The present invention also relates to a packing method and machine for producing a single-dose break-open package.

BACKGROUND OF THE INVENTION

A sealed single-dose package normally comprises a sealed sachet defining a sealed inner pocket containing a dose of a liquid product (e.g. sauce, such as ketchup, or liquid detergent) or a cream (e.g. sauce, such as mayonnaise, or skin cream). The sachet is torn open and, for this reason, has a small incision to tear it open easily.

It is extremely difficult, however, to achieve tear-open sachets that are both easy to open (i.e. with little effort) and yet strong enough to prevent them from being torn open accidentally (thus resulting in severe soiling, given the type of products contained in the sachets). The problem is further compounded in the case of sachets of detergents (soap, shower or bath foam, shampoo) which are normally opened with wet hands, thus reducing grip. Moreover, tear-open sachets of the above type are unhygienic, on account of the product, once the sachet is torn open, invariably coming into contact with the outer surface of the sachet close to the tear line (this obviously only applies to food products).

To eliminate the above drawbacks, a break-open as opposed to tear-open package has been proposed. One example of a sealed single-dose break-open package is illustrated in U.S. Pat. No. 6,041,930B1, which describes a package formed from a sheet of semirigid plastic material and a sheet of flexible plastic material superimposed and sealed to each other to define a sealed pocket containing a dose of the product; and the sheet of semirigid plastic material has a straight central incision for guiding controlled breakage of the sheet of semirigid plastic material. In actual use, to open the package, the user simply grips the package with the fingers of one hand, and bends the package to break the sheet of semirigid plastic material along the incision. By so doing, the product flows smoothly and hygienically out of the package, by not coming into contact with the outer surface of the package.

In a sealed single-dose break-open package of the type described in U.S. Pat. No. 6,041,930B1, however, the product flows out extremely fast, with no possibility of regulating flow, particularly in the case of a liquid (i.e. low-density) product. This drawback is substantially due to the sheet of semirigid plastic material being broken instantaneously along practically the whole incision, thus forming a very large outlet.

By way of a solution to the problem, i.e. to permit more controllable outflow of the product, a V-shaped incision has been proposed, as described in U.S. Pat. No. 6,945,391B2. In this case, breakage of the sheet of semirigid plastic material should be limited initially to the central part of the incision (i.e. the tip of the "V") and then extend along the rest of the incision, so that the user should be able to form a break, and hence a small outlet, limited to the central part of the incision. Various tests, however, show the solution proposed in U.S. Pat. No. 6,945,391B2 also fails to effectively solve the problem of controlling outflow of the product easily and intuitively, particularly in the case of a liquid product.

To produce a sealed single-dose break-open package, U.S. Pat. No. 6,041,930B1 proposes a packing machine, in which a strip of semirigid plastic material and a strip of flexible plastic material are unwound off respective reels and superimposed at a first longitudinal sealing station, where a metering device feeds the product between the two strips, which are then immediately sealed laterally and longitudinally (i.e. parallel to the strips) to form a tube containing the product. Downstream from the longitudinal sealing station, a further transverse sealing station seals the strips transversely (i.e. perpendicular to the strips) to form along a tube a number of pockets, each containing a dose of product. And finally, downstream from the transverse sealing station, a cutting station cuts the two strips transversely to separate the sealed single-dose packages successively.

The sealed single-dose packages produced on the packing machine described above, however, are of poor quality, by having weak transverse seals and containing a large amount of air. It is important to note that a large amount of air inside a sealed single-dose package seriously affects the appearance of the package and, in the case of a food product, greatly reduces the shelf lie of the product.

BRIEF SUMMARY OF THE INVENTION

It is an object of the present invention to provide a sealed single-dose break-open package designed to eliminate the aforementioned drawbacks, and which, in particular, is cheap and easy to produce.

It is a further object of the present invention to provide a packing method and machine for producing a single-dose break-open package, which method and machine are designed to eliminate the aforementioned drawbacks and, in particular, are cheap and easy to implement.

According to the present invention, there is provided a sealed single-dose break-open package as claimed in the accompanying Claims.

According to the present invention, there are also provided a packing method and machine for producing a single-dose break-open package as claimed in the accompanying Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 2:
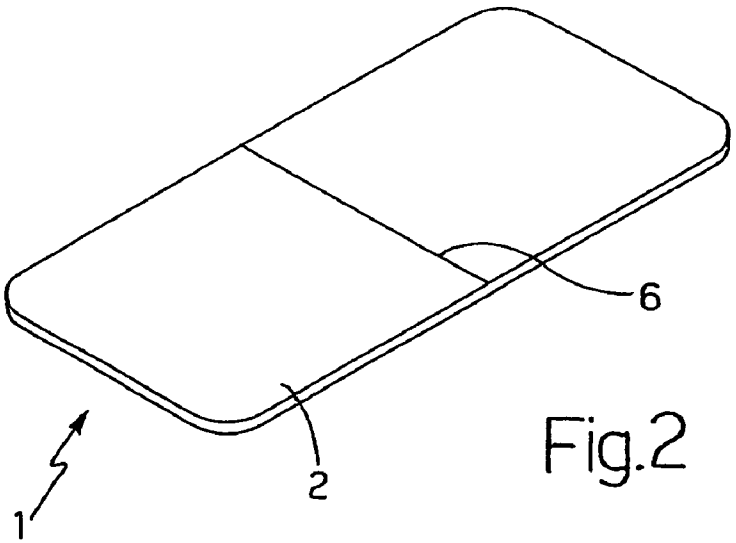
FIG. 2 shows an underside view in perspective of the FIG. 1 package.
Figure 1:
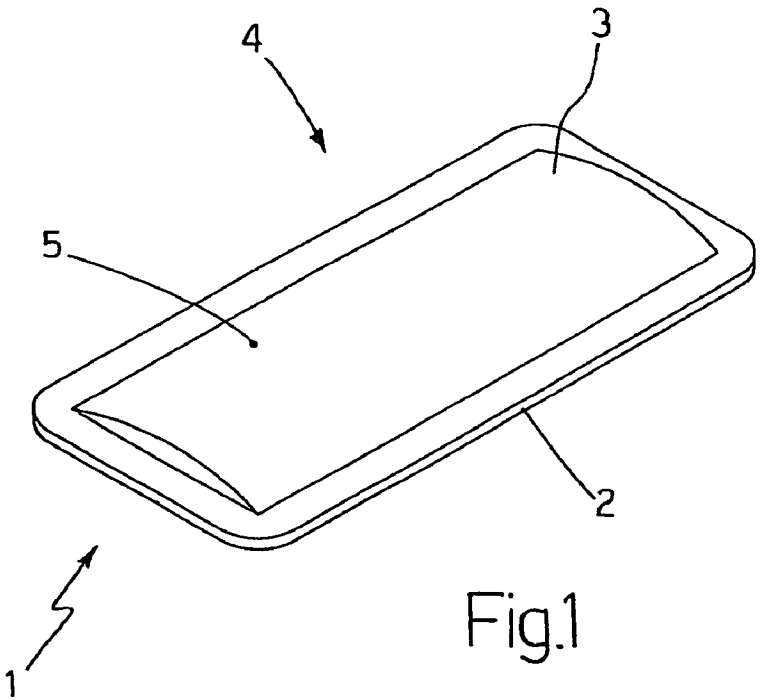
FIG. 1 shows a topside view in perspective of a sealed single-dose break-open package in accordance with the present invention.

Number 1 in FIGS. 1 and 2 indicates as a whole a sealed single-dose break-open package. Package 1 comprises a rectangular sheet 2 of semirigid plastic material; and a sheet 3 of flexible plastic material superimposed on and sealed to sheet 2 of semirigid plastic material to form a sealed pocket 4 containing a dose of a product 5 (liquid, cream, or powder).

Sheet 2 of semirigid plastic material has a central incision 6 extending crosswise to sheet 2 of semirigid plastic material (i.e. parallel to a short side of sheet 2 of semirigid plastic material) to guide controlled breakage of sheet 2 along incision 6 and form an outlet for product 5 through sheet 2. In other words, in actual use, to open package 1, the user simply grips package 1 with the fingers of one hand, and bends package 1 to break sheet 2 of semirigid plastic material along incision 6, so that product 5 flows smoothly and hygienically out of package 5, by not coming into contact with the outer surface of package 1 (i.e. sheet 2 of semirigid plastic material).

As shown in FIGS. 3-8, incision 6 varies in depth lengthwise to break sheet 2 of semirigid plastic material gradually along incision 6. More specifically, incision 6 is deepest along a central portion of incision 6. In other words, breakage of sheet 2 of semirigid plastic material along incision 6 is always gradual, i.e. proportional to the extent to which package 1 is bent, so that, when package 1 is bent relatively lightly, sheet 2 of semirigid plastic material only breaks along the central portion of incision 6, and, as package 1 is bent further, breakage of sheet 2 of semirigid plastic material also extends to the peripheral portions of incision 6.

Figure 3:
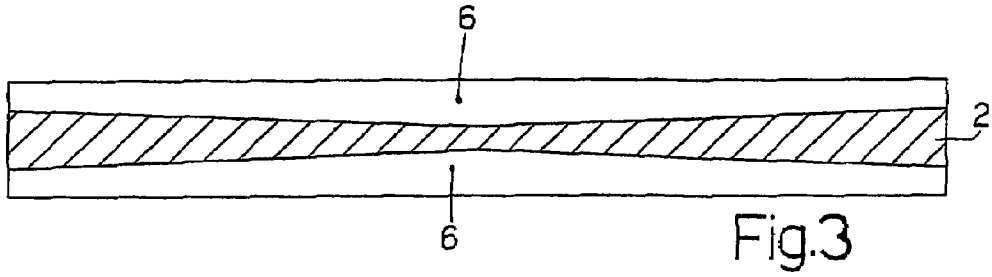
FIG. 3 shows a lateral section, along an incision, of the FIG. 1 package.
Figure 7:
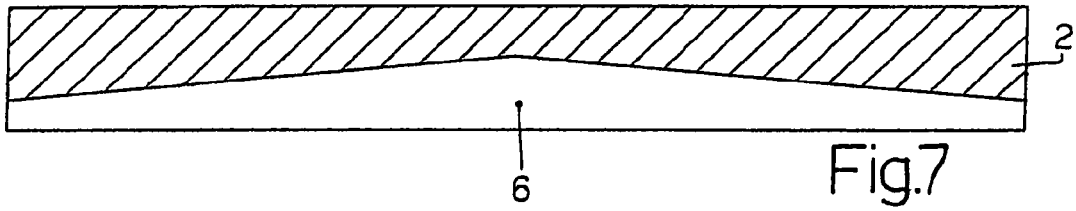

In FIGS. 3 and 7, incision 6 has a V-shaped cross section.

Figure 4:
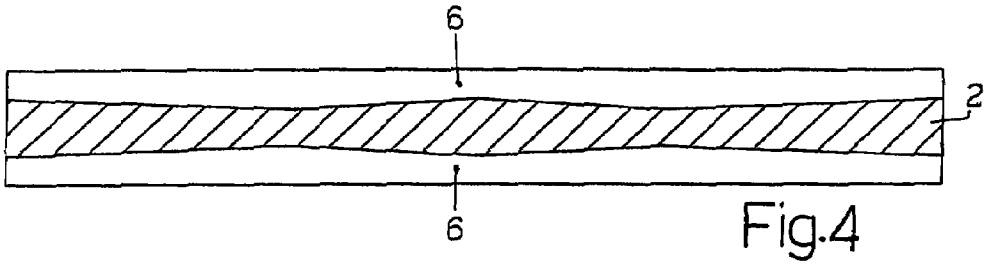
FIGS. 4-8 show lateral sections, along an incision, of variations of the FIG. 1 package.
Figure 8:
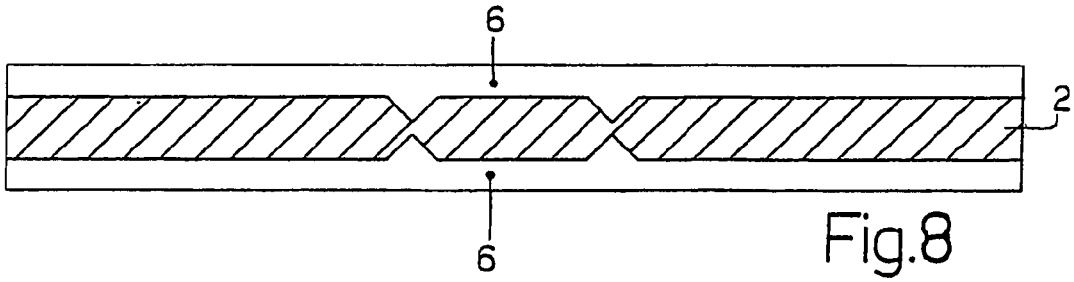

In FIGS. 4 and 8, incision 6 has a W-shaped cross section.

Figure 5:
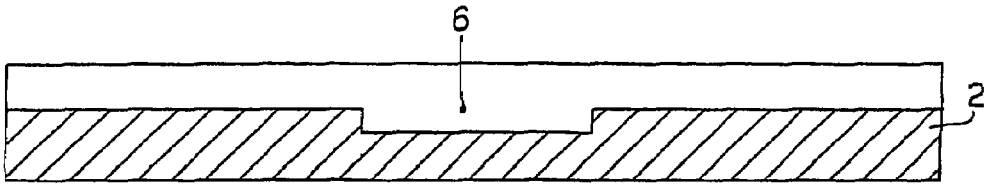
Figure 6:
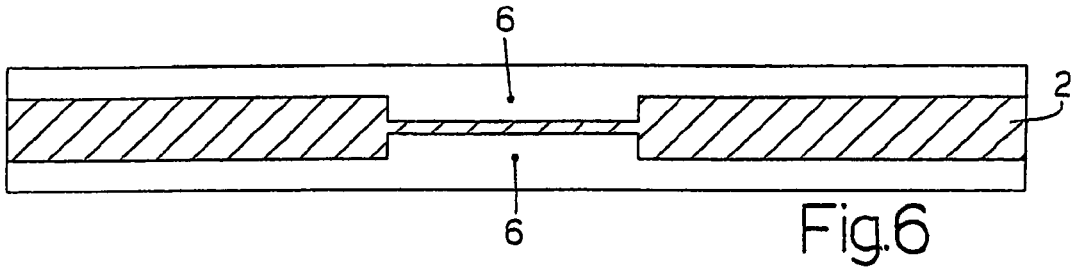

In FIGS. 5 and 6, incision 6 has a constant first depth along the peripheral portions, and a constant second depth, greater than the first depth, along the central portion.

In FIGS. 3, 4, 6 and 8, incision 6 is formed symmetrically on both sides of sheet 2 of semirigid plastic material. Alternatively, in FIGS. 5 and 7, incision 6 is only formed on one side of sheet 2 of semirigid plastic material.

In a preferred non-limiting embodiment, sheet 2 of semirigid plastic material is a laminate, and comprises an outer first supporting layer and an inner heat-sealable second layer (i.e. contacting sheet 3 of flexible plastic material). A further insulating or barrier layer may be provided between the supporting layer and the heat-sealable layer to ensure impermeability to air and/or light.

The supporting layer of sheet 2 of semirigid plastic material may comprise one of the following materials: polystyrene (PS), polyvinyl chloride (PVC), acrylonitrile butadiene styrene (ABS), amorphous polyethylene terephthalate (APET), or polypropylene (PP), and is of a thickness ranging between 300 microns and 700 microns.

The heat-sealable layer of sheet 2 of semirigid plastic may comprise one of the following materials: polyethylene (PE) or polypropylene (PP), and is of a thickness ranging between 20 microns and 50 microns.

Table 1 below shows the possible material and thickness combinations of sheet 2 of semirigid plastic material.

TABLE 1

| Sheet 2 of semirigid plastic material | | |
|---|---|---|
| Type of laminate | Thickness (microns) | |
| PS - PE | PS 300 ÷ 700 | PE 20 ÷ 50 |
| PS - PP | PS 300 ÷ 700 | PP 20 ÷ 50 |
| PVC - PE | PVC 300 ÷ 700 | PE 20 ÷ 50 |
| ABS - PE | ABS 300 ÷ 700 | PE 20 ÷ 50 |
| APET - PE | APET 300 ÷ 700 | PE 20 ÷ 50 |
| PP - PE | PP 300 ÷ 700 | PE 20 ÷ 50 |

In a preferred embodiment, the supporting layer of sheet 2 of semirigid plastic material comprises 450-micron-thick polystyrene (PS), and the heat-sealable layer of sheet 2 of semirigid plastic material comprises 35-micron-thick polyethylene (PE). In which case, sheet 2 of semirigid plastic material has a thickness of about 485 microns, a typical weight of about 500 g/m$^2$, a typical break load of about 16 N/mm$^2$, and a typical modulus of elasticity of about 2200 N/mm$^2$.

In a preferred non-limiting embodiment, sheet 3 of flexible plastic material comprises a laminate of two, three, or four layers.

The layers of sheet 3 of flexible plastic material may comprise: polyethylene terephthalate (PET), polyethylene (PE), polyethylene with a barrier layer (PE BARRIER), metalized polyethylene terephthalate (PETM), aluminium (ALU), oriented polypropylene (OPP), oriented polyamide (OPA).

Table 2 below shows the possible material and thickness combinations of sheet 3 of flexible plastic material.

TABLE 2

| Sheet 3 of flexible plastic material | |
|---|---|
| Type of laminate | Thickness (microns) |
| PET - PE | PET 12 ÷ 30/PE 20 ÷ 150 |
| PET - PE BARRIERA | PET 12 ÷ 30/PE 30 ÷ 150 |
| PET BARRIERA - PE | PET 12 ÷ 30/PE 20 ÷ 150 |
| PET - PETM - PE | PET 12 ÷ 30/PETM 12 ÷ 23/PE 20 ÷ 150 |
| PET - ALU - PE | PET 12 ÷ 30/ALU 6 ÷ 30/PE 20 ÷ 150 |
| OPP - ALU - PE | OPP 15 ÷ 3/ALU 6 ÷ 30/PE 20 ÷ 150 |
| OPA - ALU - PE | OPA 15 ÷ 30/ALU 6 ÷ 30/PE 20 ÷ 150 |
| PET - ALU - PET - PE | PET 12 ÷ 30/ALU 6 ÷ 30/PE 20 ÷ 150 |
| PET - PET BARRIERA - PE | PET 12 ÷ 30/PET BARR 12 ÷ 30/ PE 20 ÷ 150 |
| PET - ALU - OPA - PE | PET 12 ÷ 30/OPA 15 ÷ 30/ALU 6 ÷ 30/ PE 20 ÷ 150 |

In a preferred non-limiting embodiment, at the maximum depth of incision 6, sheet 2 of semirigid plastic material is of a depth ranging between 75 and 150 microns, and, for example, of 100 microns; and the difference between the maximum and minimum depth of incision 6 ranges between 50 and 150 microns, and is, for example, 100 microns.

In the embodiments shown in the attached drawings, incision 6 is straight and parallel to the short side of sheet 2 of semirigid plastic material. In other embodiments not shown, incision 6 may be shaped differently, e.g. may be curved (e.g. in the form of an arc of a circle or an arc of an ellipse), or may be V-shaped, U-shaped, or L-shaped. In other embodiments not shown, incision 6 may be inclined, i.e. may slope with respect to the sides of sheet 2 of semirigid plastic material.

Figure 10:
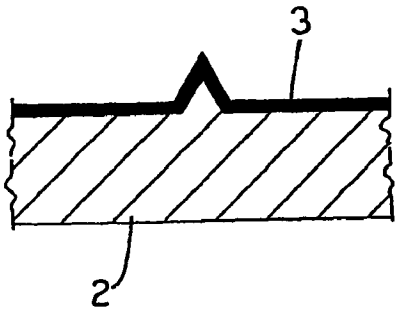
FIG. 10 shows a cross section of a detail of the FIG. 9 package.
Figure 9:
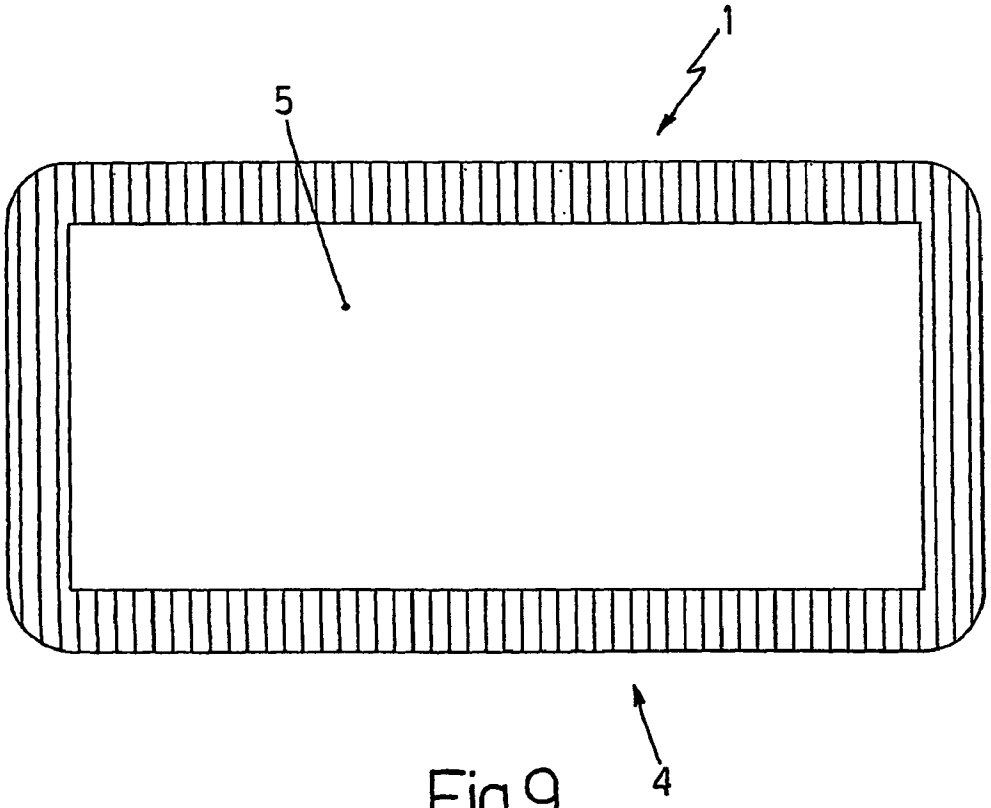
FIG. 9 shows a plan view of a variation of the FIG. 1 package.

In one possible embodiment shown in FIGS. 9 and 10, the portions of sheets 2 and 3 heat sealed to each other and surrounding pocket 4 (i.e. in the form of a rectangular border) are knurled on top (i.e. on sheet 3 of flexible plastic material). The knurling is defined by a number of ribs extending parallel to the short side of package 1. Each rib is typically 0.20 mm (more generally, 0.10 mm to 0.30 mm) in height, and has a triangular (i.e. inverted-V-shaped) cross section with a vertex angle of typically 60° (more generally, of 45° to 75°). The ribs are typically spaced 1.5 mm (more generally, 1 mm to 2 mm) apart.

It is important to note that the knurling on the parallel short sides of the portions of sheets 2 and 3 surrounding pocket 4 may differ from the knurling on the parallel long sides, perpendicular to the short sides, of the portions of sheets 2 and 3 surrounding pocket 4.

The knurling of the heat-sealed portions of sheets 2 and 3 surrounding pocket 4 serves to strengthen the heat seal and so prevent it from flaking with time (particularly when pocket 4 contains a corrosive product 5).

Package 1 as described above has numerous advantages: it is cheap and easy to produce, while at the same time enabling easy, intuitive control of the outflow of product 5. More specifically, easy control of the outflow of product 5 is achieved by virtue of the difference in thickness of incision 6, which means breakage of sheet 2 of semirigid plastic material is initially limited to the central portion of incision 6, and only later extends along the rest of incision 6. A small break in sheet 2 of semirigid plastic material can thus be formed easily and intuitively to form a small outlet through which product 5 flows slowly. Obviously, fast outflow of product 5 can be achieved by simply increasing the size of the break in sheet 2 of semirigid plastic material, i.e. increasing the size of the outlet, by simply bending package 1 further.

In other words, in package 1 described above, breakage of sheet 2 of semirigid plastic material along incision 6 is always gradual, i.e. proportional to the extent to which package 1 is bent, so that outflow of product 5 can be regulated easily and intuitively by simply bending package 1 accordingly.

Figure 11:
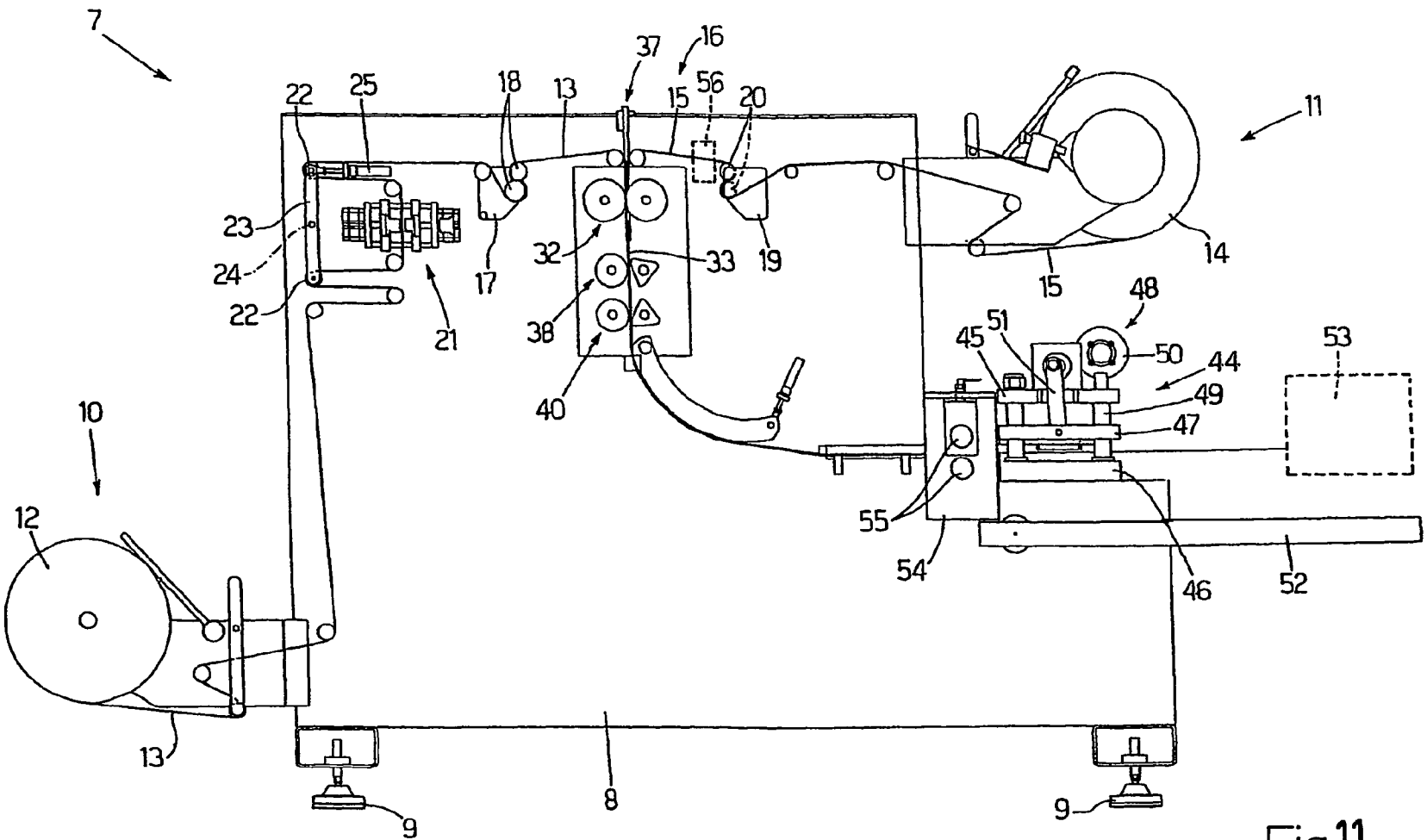
FIG. 11 shows a schematic front view, with parts removed for clarity, of a packing machine, in accordance with the present invention, for producing the FIG. 1 package.

Number 7 in FIG. 11 indicates as a whole a packing machine for producing sealed single-dose packages 1 as described above and as shown in FIGS. 1 and 2.

Packing machine 7 comprises a frame 8, which rests on the floor on a number of supporting feet 9, and supports two unwinding devices 10 and 11. Unwinding device 10 supports a reel 12, from which a strip 13 of semirigid plastic material is gradually unwound and fed to a forming station 16; and unwinding device 11 supports a reel 14, from which a strip 15 of flexible plastic material is unwound and also fed to forming station 16.

A powered traction device 17 between unwinding device 10 and forming station 16 comprises two powered rollers 18 for feeding strip 13 of semirigid plastic material continuously to forming station 16. And similarly, a powered traction device 19 between unwinding device 11 and forming station 16 comprises two powered rollers 20 for feeding strip 15 of flexible plastic material continuously to forming station 16.

Upstream from forming station 16, a scoring device 21 scores strip 13 of semirigid plastic material transversely to form, along strip 13 of semirigid plastic material, a succession of incisions 6.

In a preferred embodiment, strip 13 of semirigid plastic material is fed continuously through scoring device 21. For which purpose, two tensioning feed rollers 22 are provided upstream from scoring device 21, and are movable in opposition to elastic means to allow temporary stoppage of strip 13 of semirigid plastic material inside scoring device 21. Preferably, tensioning feed rollers 22 are fitted to the opposite ends of a supporting arm 23 hinged to rotate freely about a central axis of rotation 24; and one end of supporting arm 23 is connected to a pneumatic cylinder 25, which pushes on supporting arm 23 to keep strip 13 of semirigid plastic material taut.

Figure 13:
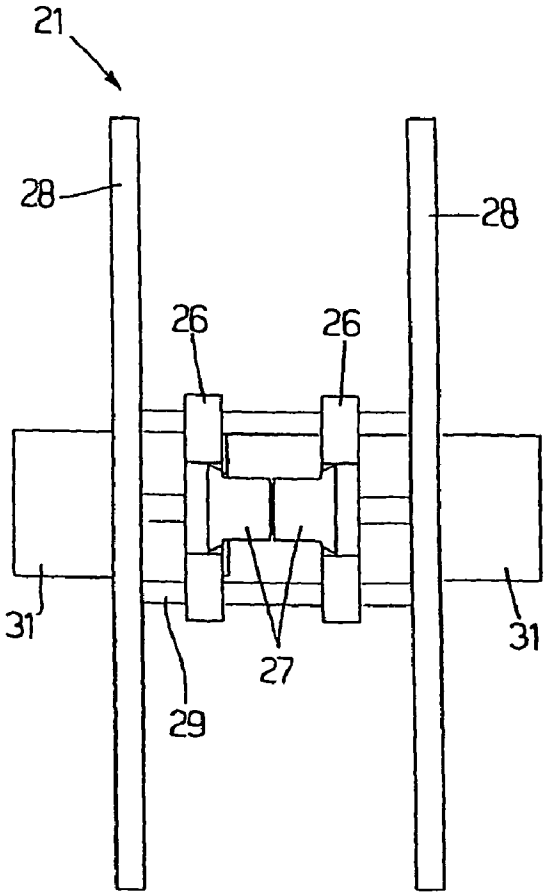
FIG. 13 shows a schematic front view, with parts removed for clarity, of the FIG. 12 scoring station.
Figure 12:
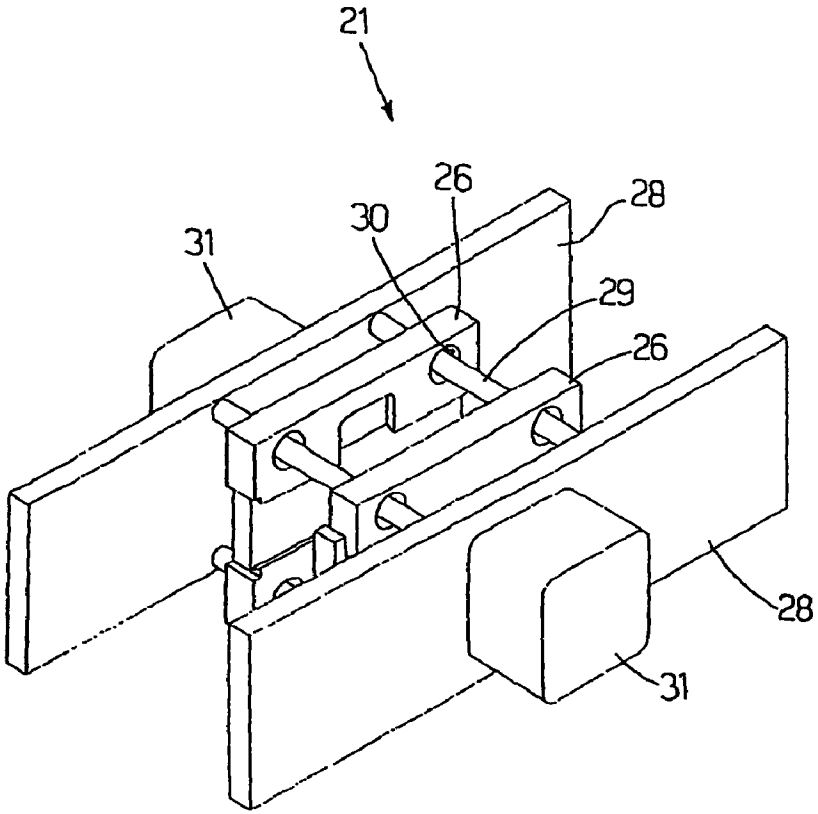
FIG. 12 shows a schematic view in perspective, with parts removed for clarity, of a scoring station of the FIG. 11 packing machine.
Figure 14:
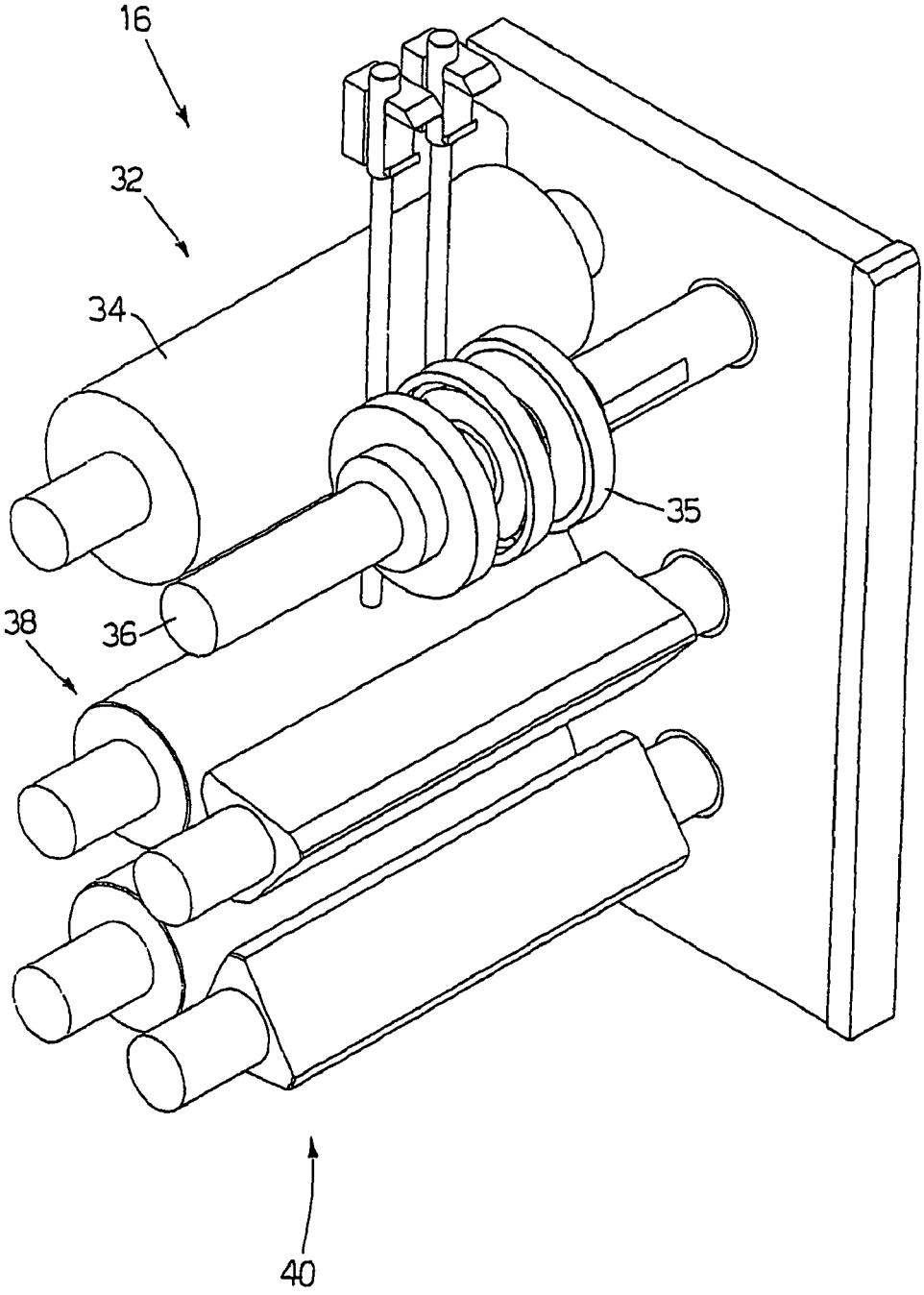
FIG. 14 shows a schematic view in perspective, with parts removed for clarity, of a sealing station of the FIG. 11 packing machine.
Figure 16:
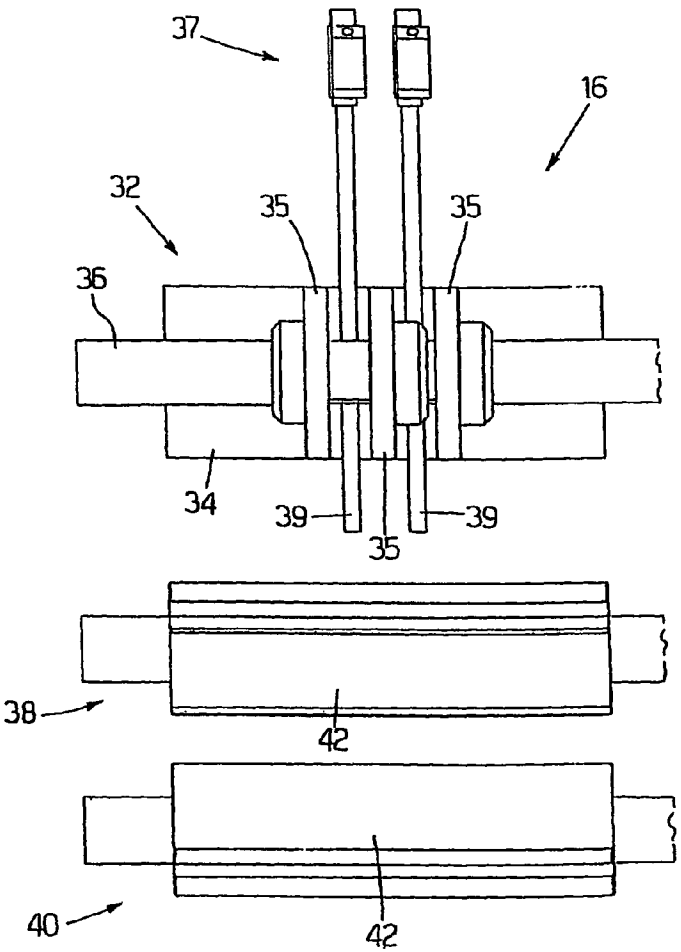
FIG. 16 shows a schematic side view, with parts removed for clarity, of the FIG. 14 sealing station.
Figure 15:
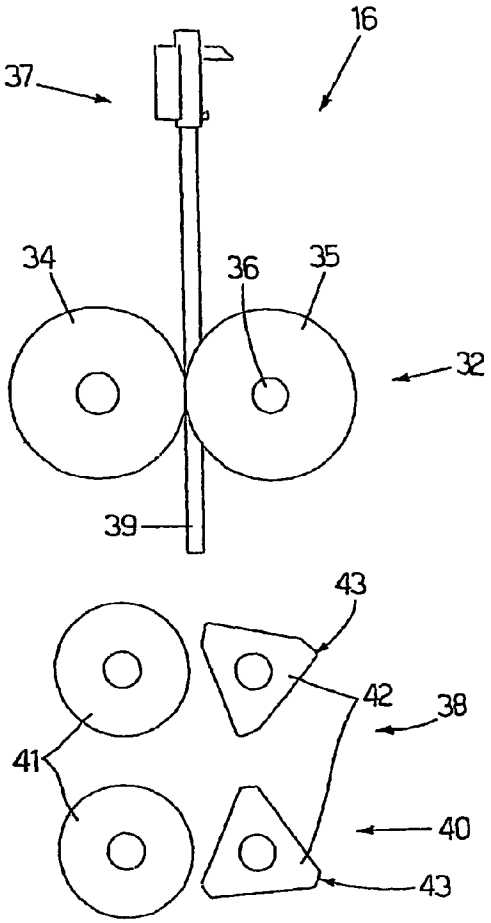
FIG. 15 shows a schematic front view, with parts removed for clarity, of the FIG. 14 sealing station.

As shown in FIGS. 12 and 13, scoring device 21 comprises two parallel, facing scoring plates 26, which are movable towards each other to grip strip 13 of semirigid plastic material, and are fitted with respective interchangeable scoring members 27. More specifically, scoring member 27 of each scoring plate 26 is connected to scoring plate 26 by a dovetail joint and at least one screw. It is important to note that, depending on the form of incision 6 to be made, both scoring members 27 may comprise sharp blades (not shown), or one scoring member 27 may comprise a sharp blade, and the other scoring member 27 may comprise a contrast surface.

In a preferred embodiment, scoring device 21 comprises a fixed frame 28 supporting four cylindrical guide members 29, which extend through respective through holes 30 formed in scoring plates 26, so that scoring plates 26 slide along guide members 29. Scoring device 21 also comprises two linear actuators 31 (typically, pneumatic or hydraulic cylinders) which push scoring plates 26 towards each other.

As shown in FIGS. 11, 14, 15 and 16, at forming station 16, strip 13 of semirigid plastic material is superimposed on strip 15 of flexible plastic material, and a longitudinal sealing device 32 seals the two strips 13, 15 longitudinally to each other (both laterally and centrally) to form two side by side tubes 33. Longitudinal sealing device 32 preferably comprises a cylindrical-section contrast roller 34; and three cylindrical-section, electrically heated sealing rollers 35 fitted to a common shaft 36. Sealing rollers 35 are preferably movable along common shaft 36 to permit fast adjustment of the axial position of the rollers to the width of strips 13 and 15 for sealing.

At forming station 16, a metering device 37 upstream from longitudinal sealing device 32 feeds a measure of a product inside each tube 33 between strip 13 of semirigid plastic material and strip 15 of flexible plastic material. A transverse sealing device 38 downstream from metering device 37 seals the two strips 13 and 15 to each other transversely to form, along each tube 33, a number of pockets 4 (FIG. 1), each containing a dose of product. Metering device 37 preferably comprises two product feed conduits 39, each having a vertical end portion which comes out between longitudinal sealing device 32 and transverse sealing device 38, and is located between sealing rollers 35 of longitudinal sealing device 32.

A further transverse sealing device 40 downstream from transverse sealing device 38 provides for further transverse sealing of strips 13 and 15. More specifically, transverse sealing device 38 forms a narrow preliminary transverse seal of strips 13 and 15, and further transverse sealing device 40 forms a further, wide final transverse seal of strips 13 and 15. Sealing strips 13 and 15 transversely in two separate successive steps produces high-quality, extremely strong transverse seals, and sealed single-dose packages 1 with no air inside. The latter result is achieved by virtue of transverse sealing device 38 only having to form a narrow preliminary transverse seal of strips 13 and 15, and so being able to operate extremely fast and prevent air entering each tube 33. In other words, transverse sealing device 38 provides for simply forming a not necessarily strong or good-quality preliminary transverse seal of strips 13 and 15 as fast as possible; and, immediately after, further transverse sealing device 40 forms a final transverse seal of strips 13 and 15 with no speed requirement involved.

In a preferred embodiment shown in the attached drawings, sealing devices 32, 38, 40 are aligned vertically and successively beneath one another.

In a preferred embodiment, the wide final transverse seal is 4 to 5 mm wide, and the narrow preliminary transverse seal is 1 to 3 mm wide. The wide final transverse seal is preferably about twice the width of the narrow preliminary transverse seal. For example, the wide final transverse seal is about 5 mm wide, and the narrow preliminary transverse seal is about 2.5 mm wide. The actual size of the transverse and longitudinal seals may obviously differ from those suggested above, depending on the characteristics of strips 13 and 15, of the product, and of the sealed single-dose packages 1 being produced.

In a preferred embodiment, each transverse sealing device 38, 40 comprises a cylindrical-section contrast roller 41; and an electrically heated sealing roller 42 having an equilateral-triangular section and cooperating with contrast roller 41. The vertices of each sealing roller 42 are bevelled (flattened) to form on sealing roller 42 three sealing surfaces 43 at 120° with respect to one another.

A cutting device 44 downstream from forming station 16 cuts each tube 33 transversely to separate sealed single-dose packages 1 successively. Preferably, cutting device 44 punch-cuts each tube 33 to separate sealed single-dose packages 1 successively. If necessary, cutting device 44 also comprises a punch (not shown) for also perforating each sealed single-dose package 1 to form a through hole by which to hang sealed single-dose package 1.

Cutting device 44 comprises a fixed frame 45; a fixed contrast plate 46 fitted to frame 45; a cutting plate 47 movable back and forth to and from contrast plate 46 and supporting a number of knives; and an actuator 48 for moving cutting plate 47 back and forth to and from contrast plate 46. Fixed frame 45 supports four cylindrical guide members 49 extending through respective through holes (not shown) in cutting plate 47, so that cutting plate 47 slides along guide members 49. Actuator 48 preferably comprises a rotary electric motor 50, which moves cutting plate 47 back and forth via a connecting rod 51.

Once detached from tubes 33, sealed single-dose packages 1 drop by force of gravity onto an output belt conveyor 52 underneath cutting device 44. Downstream from cutting device 44, a shredding device 53 is preferably provided to shred the remains of tubes 33 once sealed single-dose packages 1 are separated; and the shredded remains of tubes 33 are collected in a bin (not shown) underneath shredding device 53.

In a preferred embodiment, strips 13 and 15 are fed continuously through sealing devices 32, 38, 40 (i.e. through forming station 16) and in steps through cutting device 44. For which purpose, a traction device 54, having two powered step-operated rollers 55, is provided between forming station 16 and cutting device 44.

In a preferred embodiment, strips 13 and 15 are preprinted, and have reference marks which are read by optical sensors to synchronize operation so that the printed areas are centred correctly on the finished sealed single-dose packages 1. The reference marks are preferably printed in the areas of strips 13, 15 discarded by cutting device 44, and so do not form part of the finished sealed single-dose packages 1.

A further embodiment comprises a heating device 56 (shown schematically by a dash line in FIG. 11) upstream from forming station 16 to heat and increase the flexibility of strip 15 of flexible plastic material. Heating strip 15 of flexible plastic material beforehand temporarily increases the flexibility of strip 15 of flexible plastic material, so that a larger amount of product can be fed into pocket 4 to obtain a highly attractive sealed single-dose package 1.

To form the knurling shown in FIGS. 9 and 10, the outer surface of each sealing roller 35 has circumferential grooves, which are spaced apart with the same spacing as the knurling ribs, and negatively reproduce the shape of the knurling ribs; and the outer surface of at least sealing roller 42 of transverse sealing device 40 has circumferential grooves, which are spaced apart with the same spacing as the knurling ribs, and negatively reproduce the shape of the knurling ribs. In one possible embodiment, only the outer surface of sealing roller 42 of transverse sealing device 40 has circumferential grooves, while sealing roller 42 of transverse sealing device 38 has no circumferential grooves. Alternatively, the outer surfaces of sealing rollers 42 of both transverse sealing devices 38 and 40 have circumferential grooves.

Packing machine 7 described above has two side by side, parallel-operating production lines, but may obviously comprise a different number of side by side, parallel-operating production lines (e.g. one or three or four), depending on the output required.

Packing machine 7 described above has numerous advantages: it is cheap and easy to produce, while at the same time producing sealed single-dose packages 1 of superior quality, with extremely strong transverse seals, and containing very little air.

The invention claimed is:

1. A sealed single-dose break-open package comprising:

a first sheet of semirigid plastic material;

a second sheet of flexible plastic material superimposed on and sealed to the first sheet of semirigid plastic material to define a sealed pocket containing a dose of a product and an incision, defined in part by a length, and formed in the first sheet of semirigid plastic material to guide controlled breakage of the first sheet along the incision and form an outlet opening for the product through the first sheet;

wherein the incision to guide controlled breakage varies in depth lengthwise to break the first sheet gradually along the incision, and wherein the incision is of maximum depth along a central portion of the length of the incision.

2. A sealed single-dose package as claimed in claim 1, wherein the incision has a V-shaped cross section.

3. A sealed single-dose package as claimed in claim 1, wherein the incision has a W-shaped cross section.

4. A sealed single-dose package as claimed in claim 1, wherein, at the maximum depth of the incision, the first sheet of semirigid plastic material has a thickness ranging between 75 and 150 microns.

5. A sealed single-dose package as claimed in claim 4, wherein, at the maximum depth of the incision, the first sheet of semirigid plastic material has a thickness of 100 microns.

6. A sealed single-dose package as claimed in claim 1, wherein the difference between the maximum depth of the incision and the minimum depth of the incision ranges between 50 and 150 microns.

7. A sealed single-dose package as claimed in claim 6, wherein the difference between the maximum depth of the incision and the minimum depth of the incision is 100 microns.

8. A sealed single-dose package as claimed in claim 1, wherein the incision is formed symmetrically in both sides of the first sheet of semirigid plastic material.

9. A sealed single-dose package as claimed in claim 1, wherein the first sheet of semirigid plastic material is defined by a laminate comprising a first outer supporting layer and a second inner heat-sealable layer.

10. A sealed single-dose package as claimed in claim 9, wherein a further insulating or barrier layer is provided between the supporting layer and the heat-sealable layer.

11. A sealed single-dose package as claimed in claim 10, wherein the supporting layer of the first sheet of semirigid plastic material comprises one of the following materials: polystyrene (PS), polyvinyl chloride (PVC), acrylonitrile butadiene styrene (ABS), amorphous polyethylene terephthalate (APET), and polypropylene (PP).

12. A sealed single-dose package as claimed in claim 11, wherein the supporting layer of the first sheet of semirigid plastic material is of a thickness ranging between 300 microns and 700 microns.

13. A sealed single-dose package as claimed in claim 9, wherein the heat-sealable layer of the first sheet of semirigid plastic material comprises one of the following materials: polyethylene (PE) and polypropylene (PP).

14. A sealed single-dose package as claimed in claim 13, wherein the heat-sealable layer of the first sheet of semirigid plastic material is of a thickness ranging between 20 microns and 50 microns.

15. A sealed single-dose package as claimed in claim 9, wherein the supporting layer of the first sheet of semirigid plastic material comprises 450-micron-thick polystyrene (PS), and the heat-sealable layer of the first sheet of semirigid plastic material comprises 35-micron-thick polyethylene (PE).

16. A sealed single-dose package as claimed in claim 15, wherein the first sheet of semirigid plastic material has a total thickness of about 485 microns, a typical weight of about 500 $g/m^2$, a typical break load of about 16 $N/mm^2$, and a typical modulus of elasticity of about 2,200 $N/mm^2$.

17. A sealed single-dose package as claimed in claim 1, wherein the second sheet of flexible plastic material is laminated and the layers of the second sheet of flexible plastic material comprise: polyethylene terephthalate (PET), polyethylene (PE), polyethylene with a barrier layer (PE BARRIER), metalized polyethylene terephthalate (PETM), aluminium (ALU), oriented polypropylene (OPP), and oriented polyamide (OPA).

* * * * *